US008684695B2

(12) United States Patent
Walunj et al.

(10) Patent No.: US 8,684,695 B2
(45) Date of Patent: Apr. 1, 2014

(54) DAMPER COVERPLATE AND SEALING ARRANGEMENT FOR TURBINE BUCKET SHANK

(75) Inventors: Jalindar Appa Walunj, Bangalore (IN); Mark Honkomp, Taylors, SC (US)

(73) Assignee: General Electric Company, Schenectady, NY (US)

( * ) Notice: Subject to any disclaimer, the term of this patent is extended or adjusted under 35 U.S.C. 154(b) by 673 days.

(21) Appl. No.: 12/984,333

(22) Filed: Jan. 4, 2011

(65) Prior Publication Data

US 2012/0171040 A1 Jul. 5, 2012

(51) Int. Cl.
*F01D 5/22* (2006.01)

(52) U.S. Cl.
USPC ..... 416/193 A

(58) Field of Classification Search
None
See application file for complete search history.

(56) References Cited

U.S. PATENT DOCUMENTS

| | | | | |
|---|---|---|---|---|
| 4,872,812 | A * | 10/1989 | Hendley et al. | 416/190 |
| 5,211,407 | A | 5/1993 | Glynn et al. | |
| 5,318,405 | A | 6/1994 | Meade et al. | |
| 5,967,745 | A | 10/1999 | Tomita et al. | |
| 6,086,329 | A * | 7/2000 | Tomita et al. | 416/193 A |
| 6,273,683 | B1 | 8/2001 | Zagar et al. | |
| 6,578,849 | B2 | 6/2003 | Haje | |
| 6,579,065 | B2 | 6/2003 | Scott et al. | |
| 7,321,044 | B2 | 1/2008 | Platzek et al. | |
| 7,731,482 | B2 * | 6/2010 | Lagrange et al. | 416/190 |
| 8,137,072 | B2 * | 3/2012 | Kim et al. | 416/193 A |
| 2006/0257262 | A1 | 11/2006 | Itzel et al. | |
| 2007/0014668 | A1 | 1/2007 | Engle | |
| 2008/0008593 | A1 | 1/2008 | Zagar et al. | |

FOREIGN PATENT DOCUMENTS

| | | | |
|---|---|---|---|
| EP | 1452692 | A2 | 1/2004 |
| GB | 2417986 | A | 3/2006 |
| WO | 2007063128 | | 6/2007 |

OTHER PUBLICATIONS

Search Report and Written Opinion from EP Application No. 11195450.9 dated Apr. 18, 2012.

* cited by examiner

*Primary Examiner* — Nathaniel Wiehe
*Assistant Examiner* — Jeffrey A Brownson
(74) *Attorney, Agent, or Firm* — Nixon & Vanderhye P.C.

(57) ABSTRACT

A bucket pair in a turbomachine includes a first bucket having an airfoil and a shank; a second adjacent bucket having a second airfoil and a second shank adjacent the first shank; a first axial slot in the first shank; and an elongated, straight damper pin adapted to seat in the first axial slot, the damper pin formed with slanted forward and aft end faces.

16 Claims, 4 Drawing Sheets

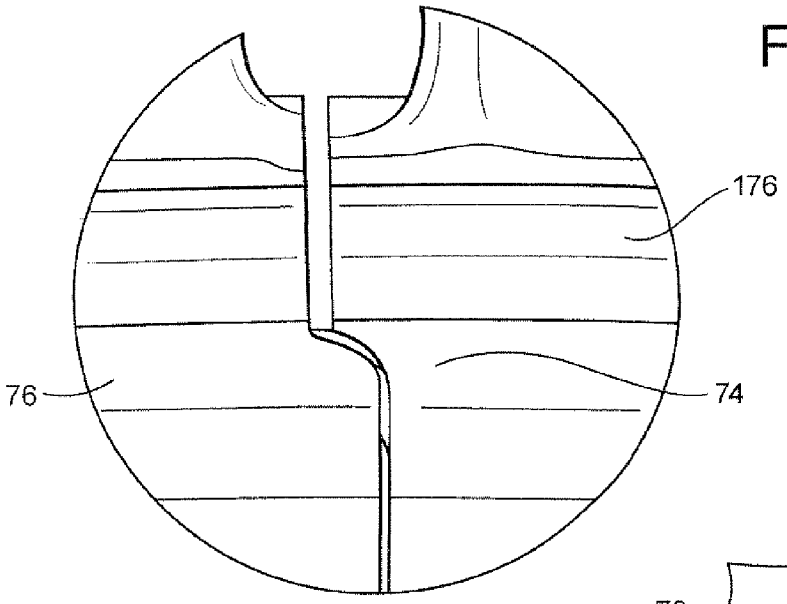
FIG. 7
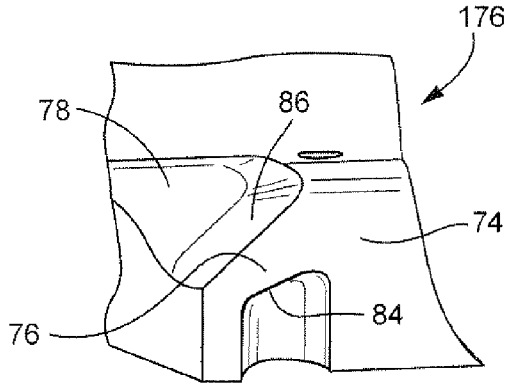
FIG. 8
FIG. 9
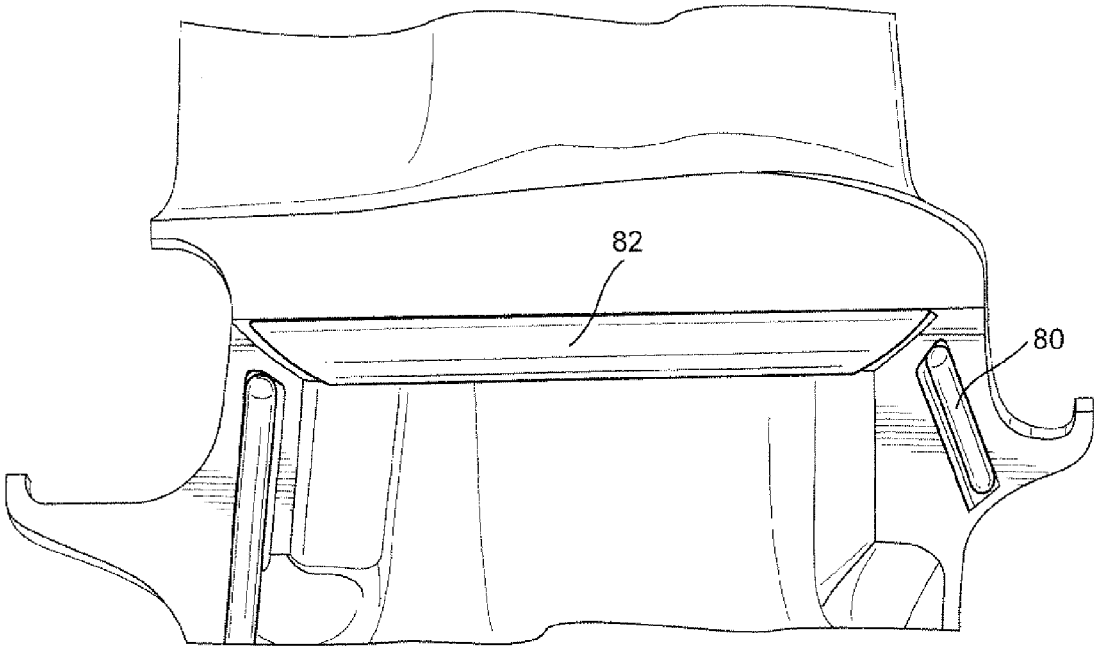

DAMPER COVERPLATE AND SEALING ARRANGEMENT FOR TURBINE BUCKET SHANK

BACKGROUND OF THE INVENTION

The present invention relates generally to turbomachines and particularly, to damper pins and seal pins disposed between adjacent buckets on a rotor wheel.

As is well known, turbines generally include a rotor comprised of a plurality of rotor wheels, each of which mounts a plurality of circumferentially-spaced buckets. The buckets each typically include an airfoil, a platform, a shank and a dovetail, the dovetail being received in mating dovetail slot in the turbine wheel. The airfoils project into a hot gas path downstream of the turbine combustors and convert kinetic energy into rotational, mechanical energy. During engine operation, vibrations are introduced into the turbine buckets and if not dissipated, can cause premature failure of the buckets.

Many different forms of vibration dampers have been proposed to minimize or eliminate vibrations. Vibration dampers are often in the form of an elongated damper pins that fit between adjacent buckets and provide the damping function by absorbing harmonic stimuli energy produced as a result of changing aerodynamic loading. A damper pin is typically retained in a groove formed along one circumferentially-oriented "slash face" in the turbine blade shank region of one of each pair of adjacent buckets. The damping pin is centrifugally loaded during operation and, in order to prevent bucket-to-bucket binding, the groove must be machined so as to allow the pin to float relatively freely within the groove. At the same time, highly-compressed air is often extracted from the compressor of an axial turbine for the purpose of cooling turbine components, particularly those in the hot gas path downstream of the combustion. This cooling air is required to maintain the temperature of the turbine components at an acceptable level for operation, but comes at a cost to overall turbine efficiency and output. Any of the cooling flow that leaks out of the turbine components is essentially wasted. The pocket created by a damper pin groove provides a large leakage path for cooling flow to escape from the bucket shank region. The cooling efficiency can also be impaired by ingress of hot gas from the hot gas path into the bucket shank region.

In one prior arrangement, the damper pin has reduced-cross-section ends supported on shoulders formed in the bucket shank, with annular seals at the interfaces between the reduced-cross-section ends and the main body portion of the pin to minimize leakage along the damper pin groove.

For industrial gas turbines utilizing long bucket shank designs, a further approach to seal against cross-shank leakage is to provide radial seal pins between the shanks of adjacent buckets on the fore and aft sides of the shank, below the axially-extending damper pin. Like the damper pin, the radial seal pins are seated in seal pin grooves formed on the same slash face as the damper pin groove, and engage the substantially flat sides of the shank of the adjacent bucket. The sealing effectiveness of these cross-shank seals is an important factor in increasing the bucket life by minimizing thermal stress. Even when using both damper pins and radial seal pins, however, gaps remain between the radial seal pins and the reduced-cross-section ends of the axially-oriented damper pin, again creating readily-available leakage paths for hot combustion gases flowing past the buckets.

It would therefore be desirable to provide a more reliable sealing feature in order to prevent, minimize or control the escape of cooling flow from a pressurized shank cavity, prevent or minimize flow from leaking across the turbine blade from the forward wheel space to the aft wheel space in the case of a non-pressurized shank cavity, and/or to prevent ingress of hot gas path air into the shank region.

BRIEF SUMMARY OF THE INVENTION

In one exemplary but nonlimiting embodiment, there is provided a bucket pair in a turbomachine comprising a first bucket having an airfoil and a shank; a second adjacent bucket having a second airfoil and a second shank adjacent the first shank; a first axial slot in the first shank; and an elongated, straight damper pin adapted to seat in the first axial slot, the damper pin formed with axially slanted forward and aft ends.

In another exemplary embodiment, there is provided a bucket for a turbine machine rotor wheel comprising an airfoil portion, a shank portion and a dovetail mounting portion, the shank portion including opposite side faces, one of the side faces formed with an axially-oriented slot extending between forward and aft ends of the shank portion; an elongated damper pin of uniform cross-section seated in the axially oriented slot, the elongated damper pin formed with axially slanted forward and aft ends.

In still another aspect, the invention provides a bucket for a turbine machine rotor wheel comprising an airfoil portion, a shank portion and a dovetail mounting portion, the shank portion including opposite side faces, one of the side faces formed with an axially-oriented slot extending between forward and aft ends of the shank portion; an elongated damper pin of uniform cross-section seated in the axially oriented slot, the elongated damper pin formed with slanted forward and aft end faces; wherein the forward and aft ends of the shank portion include material substantially covering the slanted forward and aft ends; and wherein first and second substantially radially-oriented grooves are formed at forward and aft ends of the shank portion, the first and second seal pins located in the first and second substantially radially oriented grooves.

The invention will now be described in connection with the drawings identified below.

BRIEF DESCRIPTION OF THE DRAWINGS

FIG. 7 is a partial end view of a pair of adjacent buckets incorporating the damper pin and radial seal pin arrangement of FIG. 6;

FIG. 8 is a partial perspective view of the turbine shank portion on which the damper pin rests; and FIG. 9 is a partial side elevation of a bucket incorporating a damper pin and radial seal pin configuration in accordance with another exemplary but nonlimiting embodiment.

DETAILED DESCRIPTION OF THE INVENTION

Figure 1:
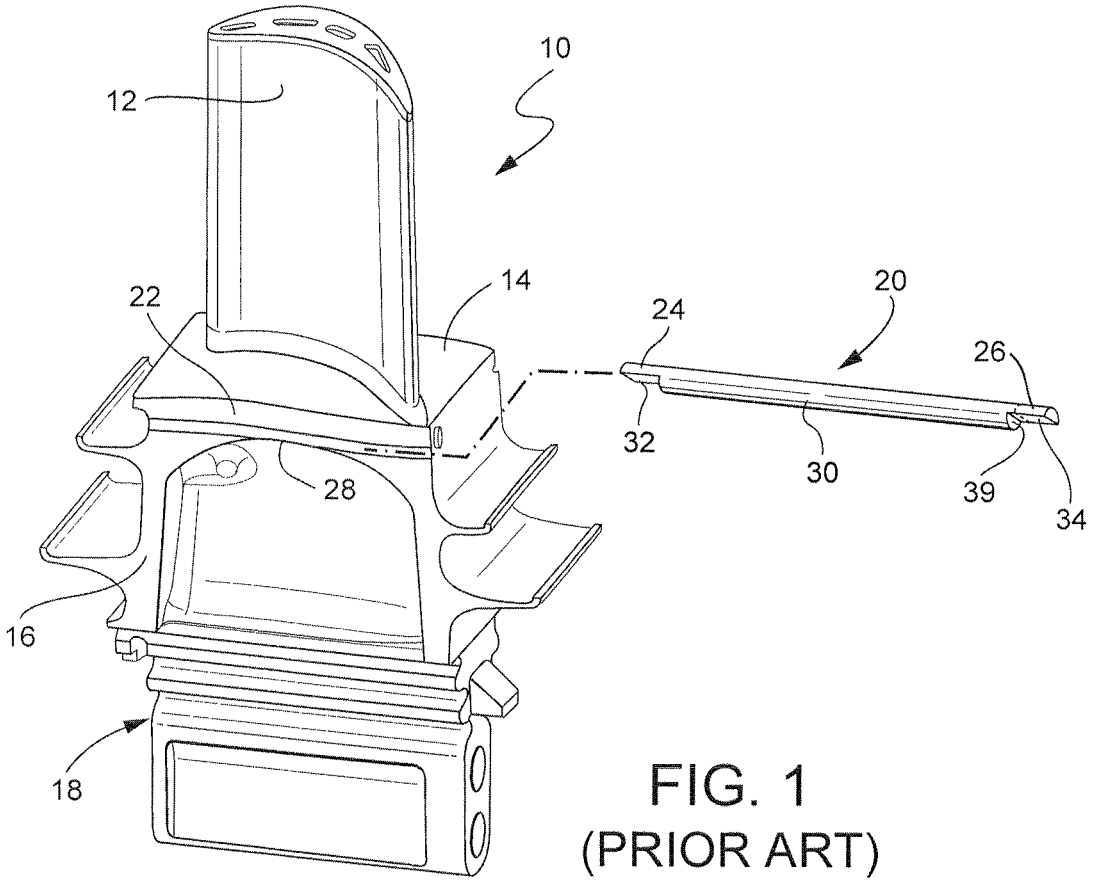
FIG. 1 (PRIOR ART)
FIG. 1 is a perspective view of a gas turbine bucket and damper pin assembly.
Figure 2:
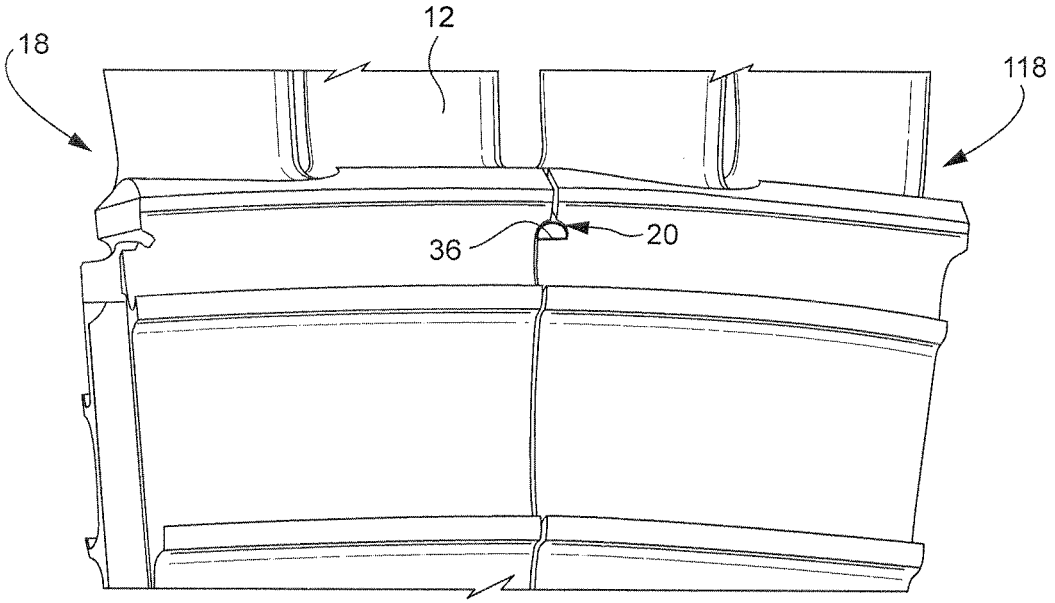
FIG. 2 (PRIOR ART)
FIG. 2 is a partial side elevation showing a pair of circumferentially-adjacent buckets with a damper pin located therebetween.

FIGS. 1 and 2 illustrate a conventional bucket 10 including an airfoil 12, a platform 14, a shank 16 and a dovetail 18. The dovetail 17 is utilized to secure the bucket 10 to the periphery of the rotor wheel (not shown), as is well understood in the art. A damper pin 20 is located along one axial edge (or slash face) 22 adjacent (i.e., radially inward of) the bucket platform 14 with the leading end 24 of the damper pin 20 located nearer the leading edge of the bucket, and the trailing end 26 of the damper pin located nearer the trailing edge of the bucket.

It will be appreciated that a similar pin 20 is located between each adjacent pair of buckets 18, 118 on the turbine wheel, as apparent from FIG. 2. Specifically, the damper pin 20 is located in a groove or slot 28 extending along the entire slash face 22 of the bucket 118. The damper pin 20 includes a substantially cylindrical body portion 30 between a pair of substantially semi-cylindrical, opposite ends 24, 26 interfacing at shoulders 39. This configuration creates flat support surfaces 32, 34 (best seen in FIG. 1) that are adapted to rest on the machined bucket platform surfaces or shoulders (one shown at 36 in FIG. 2) at opposite ends of the groove 28 formed in the bucket slash face, thereby providing good support for the pin while preventing undesirable excessive rotation during machine operation.

Figure 3:
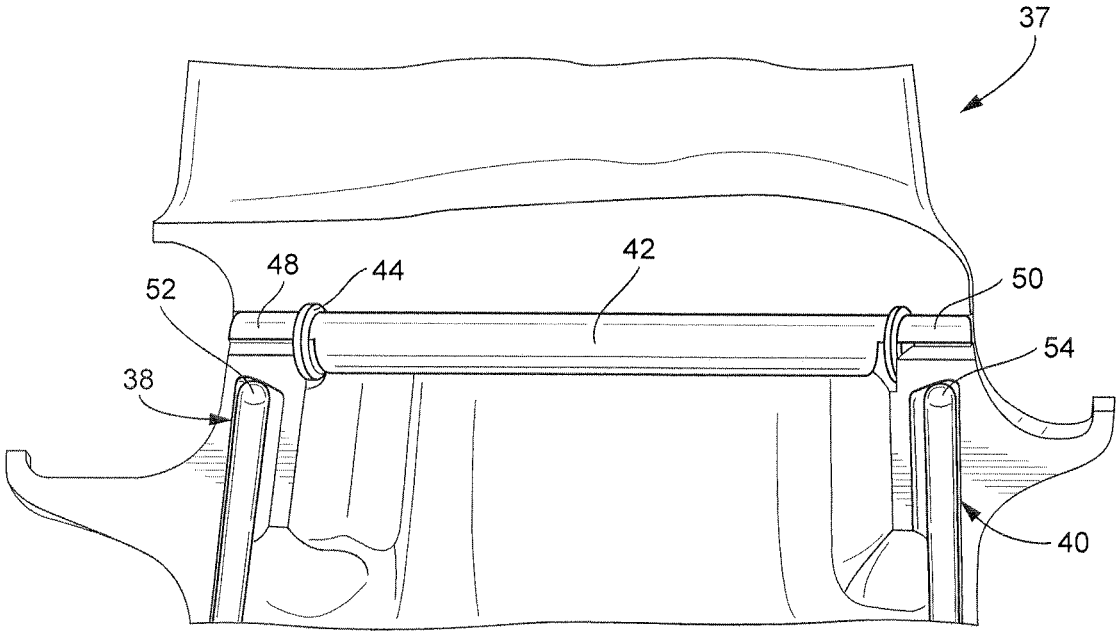
FIG. 3 (PRIOR ART)
FIG. 3 is a partial perspective view of another gas turbine bucket and damper pin assembly, wherein the damper pin is provided with discreet seal elements in one prior arrangement.
Figure 4:
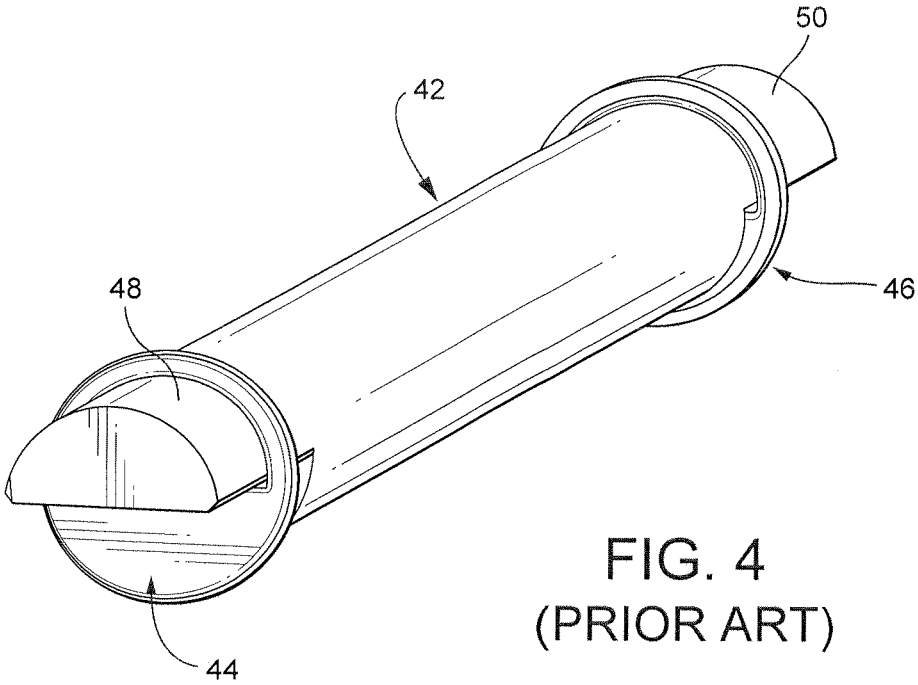
FIG. 4 (PRIOR ART)
FIG. 4 is a perspective view of a damper pin with attached discreet seal elements of the type shown in FIG. 3.
Figure 5:
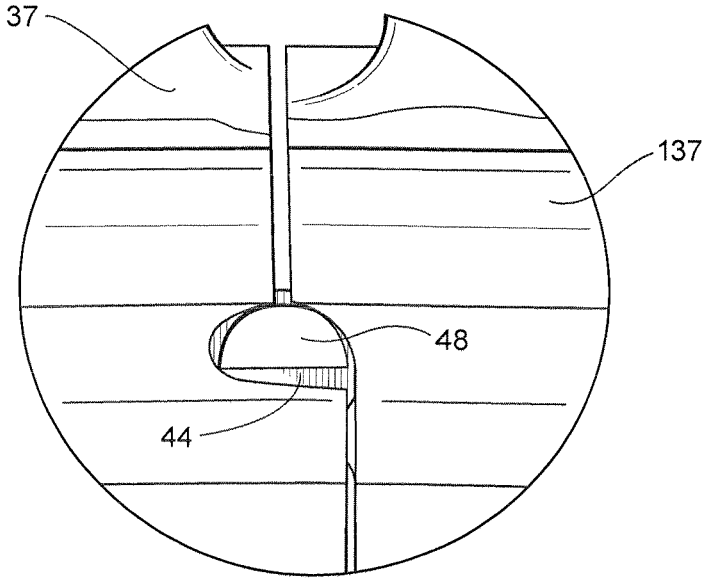
FIG. 5 (PRIOR ART)
FIG. 5 is a partial end view of a pair of adjacent buckets incorporating a damper pin/seal of the type shown in FIGS. 3 and 4.

FIGS. 3 and 4 illustrate a long bucket 37 where radially-oriented seal pins 38, 40 are used in combination with a damper pin 42. In this instance, the damper pin 42 is formed or provided with "piston ring" seals 44, 46 at opposite ends where the damper pin transitions to reduced-cross-section ends 48, 50. Note, however, that there is still a considerable gap between the radially outer ends 52, 54 of the seal pins 38, 40 and the ends 48, 50 of the damper pin 42. In addition, as made clear from FIG. 5 (where the reduced-cross-section end 48 is visible between adjacent buckets 37, 137) the slot in which the damper pin is located is open at both ends, allowing cooling air to escape through the clearance spaces between the pin and the groove in which it is seated, especially along the reduced-cross-section ends 48, 50.

It should be understood that the grooves in which the damper pin 42 and radial seal pins 38, 40 are seated are provided on only one side of the bucket, and that they engage flat surfaces on an adjacent bucket. In other words, each bucket in a circumferential row of buckets is formed such that the damper/seal pins seated in grooves formed on one side of a bucket engage flat surfaces of an opposite side of an adjacent bucket.

Figure 6:
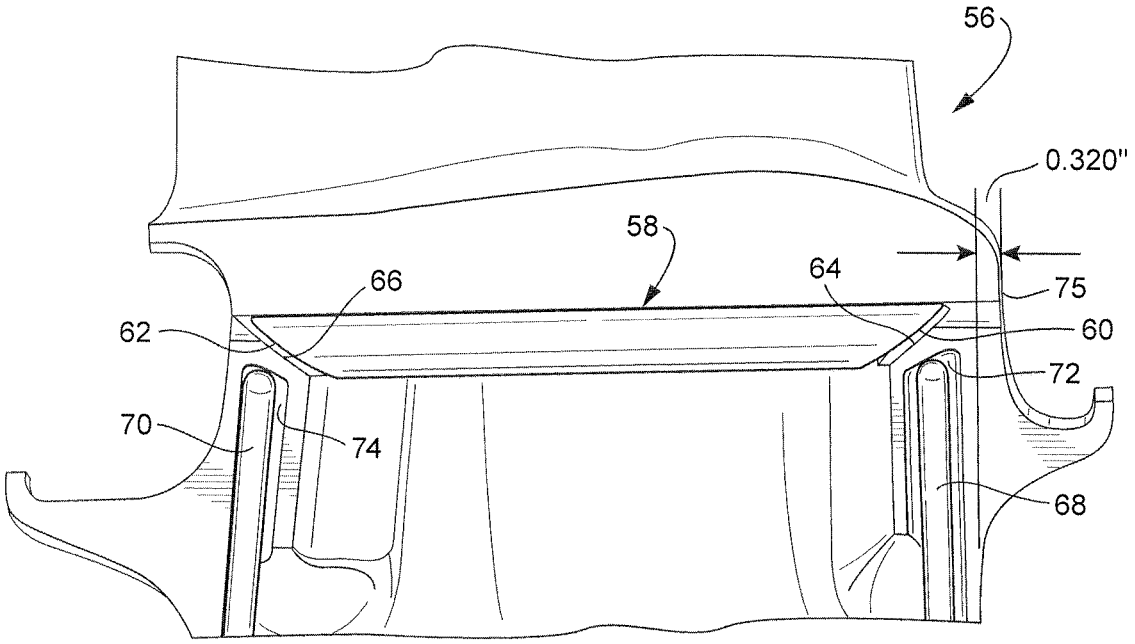
FIG. 6 is a partial side elevation of a damper pin and radial seal pin configuration in accordance with a first exemplary but nonlimiting embodiment of this invention.

FIG. 6 illustrates a bucket 56 provided damper pin/radial seal pin configuration in accordance with an exemplary but nonlimiting embodiment of the invention. Specifically, an axially-extending, substantially round damper pin 58 is formed with slanted forward and aft ends defined by, for example 45° surfaces 60, 62 that rest on similarly slanted surfaces 64, 66 formed internally of the shank, at opposite forward and aft ends thereof. More specifically, surfaces 60, 62 are slanted in opposite linear or axial directions. This design eliminates the need for the reduced-cross-section ends and the "piston ring" seals as shown in FIG. 4, and, allows the length of the damper pin 58 to be shortened. The slanted ends or surfaces 60, 62 also allow the radial seal pins 68, 70 to be extended in length in a radially outward direction to close the gap between the radial seal pins and the damper pin. For example, in one exemplary embodiment, the radial pin seal slots or grooves 72, 74 in the shank may be extended radially outwardly (toward the airfoil) by 0.140 inch, to obtain greater sealing performance. Note also that the upper or radially outer ends of the seal pin slots or grooves 72, 74 are at least partially overlapped by the slanted end surfaces 60, 62 of the damper pin 58. This arrangement also allows additional shank material to be retained at the ends of the damper pin groove surfaces 62, 64 to substantially cover the ends of the damper pin 58 as shown in FIGS. 7 and 8, further reducing the area of the leakage path. In one example, the thickness of the shank from the edge of the damper pin 58 to the forward face 72 of the shank may be on the order of 0.320 inch, thus providing sufficient material for the "cover plates" 75 (FIG. 7). A comparison of the buckets 76, 176 in FIG. 7 illustrates the significant reduction is leakage area resulting from the addition of the cover plates 75. Thus, there are two aspects of the exemplary design that reduce leakage at each of the forward and aft ends of each pair of adjacent buckets. First, the gap between the upper end of the radial pin 68 and the damper pin 56 (as defined by the solid ligament or web 76) can be reduced, and second, an increase in shank material at the opposite ends of the damper pin groove 78 enables the ends of the damper pin 56 to be substantially covered by the cover plates 75.

In another exemplary but nonlimiting example shown in FIG. 9, the forward side radial pin 80 may be shortened in length and angled more sharply toward the damper pin 82, allowing the outer end of the radial seal pin 80 to be located further up the slanted surface of the damper pin 82 to reduce the leakage area between the damper pin and seal pin. Because pressures are greater at the radially outer end of the forward side shank portion, leakage is more likely in this area than in radially inner areas of the shank.

For both described embodiments, the radially outer edges of the seal pin grooves (one referenced by numeral 84 in FIG. 8) are shown to be substantially parallel to the slanted surface of the damper pin groove (one referenced by numeral 86 in FIG. 8). It will be understood, however that these surfaces need not be parallel. The angle of edge 84 is the contact angle for the radial pin, and that angle may be optimized depending on various parameters including the loading on the pin under various operating conditions, diameter of the pin, etc. In addition, the dimensions for the damper pin and seal pin grooves, the diameter and length dimensions of the damper pin and seal pins will also be application specific, also taking into account thermal growth characteristics; damper pin-to-bucket mass ratio to insure effective vibration damping; and other parameters understood by those skilled in the art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket pair in a turbomachine comprising:

a first bucket having an airfoil and a first shank;

a second adjacent bucket having a second airfoil and a second shank adjacent said first shank;

a first axial slot in said first shank; and an elongated, straight damper pin adapted to seat in said first axial slot, said damper pin formed with forward and aft ends slanted linearly in opposite axial directions across a substantially round cross-sectional thickness of the damper pin.

2. The bucket pair of claim 1 and further comprising a first substantially radially-oriented slot at one end of said first shank; and a first seal pin having radially inner and outer ends adapted to seat in said first substantially radially-oriented slot, said radially outer end at least partially overlapped by one of said forward and aft ends.

3. The bucket pair of claim 2 further comprising a second substantially radially-oriented slot at an opposite end of said first and second shank, and a second seal pin adapted to seat in said second substantially radially-oriented seal slot, and wherein sate-a radially outer end of said second seal pin at least partially overlapped by the other of said forward and aft ends.

4. The bucket pair of claim 1 wherein said forward and aft ends rest on complimentary slanted surfaces, respectively, formed in said shank.

5. The bucket pair of claim 3 wherein said second seal pin has a length dimension shorter than a corresponding length dimension of said first seal pin.

6. A bucket for a turbine machine rotor wheel comprising:

an airfoil portion, a shank portion and a dovetail mounting portion, said shank portion including opposite side faces, one of said side faces formed with an axially-oriented slot extending between forward and aft ends of said shank portion; an elongated damper pin of uniform substantially round cross-section between forward and aft ends and seated in said axially oriented slot, said forward and aft ends slanted linearly in opposite axial directions across a cross-sectional thickness of the damper pin.

7. The bucket of claim 6 wherein said forward and aft ends of said shank portion include material substantially covering said slanted forward and aft ends of said elongated damper pin.

8. The bucket of claim 6 wherein first and second substantially radially-oriented grooves are formed at forward and aft ends of said shank portion, and wherein first and second seal pins are located in said first and second substantially radially oriented grooves.

9. The bucket of claim 8 wherein radially outer ends of said first and second seal pins, respectively, are at least partially overlapped by said slanted ends and said elongated damper pins.

10. The bucket of claim 7 wherein said forward and aft ends are slanted at about a 45° angle in an axial direction.

11. The bucket of claim 8 wherein said second seal pin has a length dimension shorter than a corresponding length dimension of said first seal pin.

12. The bucket of claim 6 wherein said damper pin is of substantially uniformly round cross-section.

13. A bucket for a turbine machine rotor wheel comprising: an airfoil portion, a shank portion and a dovetail mounting portion, said shank portion including opposite side faces, one of said side faces formed with an axially-oriented slot extending between forward and aft ends of said shank portion; an elongated, round damper pin of uniform cross-section between forward and aft ends and seated in said axially oriented slot, said forward and aft end faces slanted linearly in opposite axial directions across a cross-sectional thickness of the damper pin;

wherein said forward and aft ends of said shank portion include material substantially covering said slanted forward and aft ends; and wherein first and second substantially radially-oriented grooves are formed at forward and aft ends of said shank portion with first and second seal pins located in said first and second substantially radially oriented grooves.

14. The bucket of claim 13 wherein radially outer ends of said and second seal pins, respectively, are at least partially overlapped by said forward and aft ends and said elongated damper pins.

15. The bucket of claim 13 wherein said second seal pin has a length dimension shorter than a corresponding length dimension of said first seal pin.

16. The bucket of claim 13 wherein said forward and aft ends are slanted at about a 45° angle in opposite axial directions.

* * * * *

UNITED STATES PATENT AND TRADEMARK OFFICE

CERTIFICATE OF CORRECTION

PATENT NO. : 8,684,695 B2
APPLICATION NO. : 12/984333
DATED : April 1, 2014
INVENTOR(S) : Walunj et al.

It is certified that error appears in the above-identified patent and that said Letters Patent is hereby corrected as shown below:

In the Claims:

In Claim 16 at column 6, lines 37-38, delete "in opposite axial directions" after "at about a 45° angle"

Signed and Sealed this
Fifth Day of August, 2014

Michelle K. Lee

Michelle K. Lee
*Deputy Director of the United States Patent and Trademark Office*